US008037798B2

(12) United States Patent
Lance et al.

(10) Patent No.: US 8,037,798 B2
(45) Date of Patent: Oct. 18, 2011

(54) METHODS AND APPARATUS FOR COMMUNICATIONS BETWEEN A FIRE CONTROL SYSTEM AND AN EFFECTOR

(75) Inventors: David A. Lance, Plano, TX (US); Steven T. Siddens, McKinney, TX (US)

(73) Assignee: Raytheon Company, Waltham, MA (US)

( * ) Notice: Subject to any disclaimer, the term of this patent is extended or adjusted under 35 U.S.C. 154(b) by 738 days.

(21) Appl. No.: 12/120,432

(22) Filed: May 14, 2008

(65) Prior Publication Data

US 2011/0057070 A1 Mar. 10, 2011

Related U.S. Application Data

(60) Provisional application No. 60/917,729, filed on May 14, 2007.

(51) Int. Cl.
*F41F 3/04* (2006.01)

(52) U.S. Cl. ..... 89/1.811; 89/1.809; 89/1.819; 102/501; 114/21.2; 244/3.12

(58) Field of Classification Search ..... 89/1.811, 89/1.809, 1.81, 1, 819; 102/501; 114/21.2; 244/3.12

See application file for complete search history.

(56) References Cited

U.S. PATENT DOCUMENTS

| | | | | |
|---|---|---|---|---|
| 3,760,732 | A * | 9/1973 | Schuster et al. | 102/215 |
| 5,181,673 | A * | 1/1993 | Hubricht et al. | 244/3.12 |
| 6,610,971 | B1 | 8/2003 | Crabtree | |
| 6,920,827 | B2 | 7/2005 | Lloyd | |
| 7,066,427 | B2 | 6/2006 | Chang | |
| 2006/0175464 | A1 | 8/2006 | Chang | |

FOREIGN PATENT DOCUMENTS

WO WO 2006/091240 A2 8/2006

OTHER PUBLICATIONS

Raytheon U.S. Appl. No. 11/470,900, filed Sep. 7, 2006 for System and Method for Attitude Control of a Flight Vehicle using Pitch-Over Thrusters, not yet published.

* cited by examiner

*Primary Examiner* — J. Woodrow Eldred
(74) *Attorney, Agent, or Firm* — The Noblitt Group PLLC

(57) ABSTRACT

Methods and apparatus for communications between a fire control system and an effector according to various aspects of the present invention may include a communications link. The communications link may be coupled to a launcher for the effector and the effector. The communications link is detachably coupled to at least one of the launcher and the effector. The communications link may be adapted to transmit a fire control solution to the effector after initiating the launch.

17 Claims, 3 Drawing Sheets

METHODS AND APPARATUS FOR COMMUNICATIONS BETWEEN A FIRE CONTROL SYSTEM AND AN EFFECTOR

CROSS-REFERENCES TO RELATED APPLICATIONS

This application claims the benefit of U.S. Provisional Patent Application No. 60/917,729 filed May 14, 2007, and incorporates the disclosure of the application by reference.

BACKGROUND OF INVENTION

Modern warfare has developed new threats and new uses for old weapons. Deployments place units in areas exposed to a variety of weapons fired at close range and with little warning. Countermeasures must be developed and deployed to neutralize such threats.

For example, various rocket-propelled grenades (RPGs) are widely used against armored and unarmored targets. RPGs are typically fired within a few hundred meters of a target, and often from doorways and behind walls, providing little reaction time. Urban environments are particularly suited to PRG attacks.

Countermeasures may be available against many types of projectiles. Under many conditions, however, the countermeasures must be deployed extremely quickly, limiting the effectiveness of many countermeasures. In addition, some countermeasures, such as extra armor, may not be suited to particular units.

SUMMARY OF THE INVENTION

Methods and apparatus for communications between a fire control system and an effector according to various aspects of the present invention may include a communications link. The communications link may be coupled to a launcher for the effector and the effector. The communications link is detachably coupled to at least one of the launcher and the effector. The communications link may be adapted to transmit a fire control solution to the effector after initiating the launch.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various projectiles, sensors, launch systems, computers, tracking systems, target identification and tracking algorithms, fire control solution algorithms, and the like, which may carry out a variety of functions. In addition, the present invention may be practiced in conjunction with any number of projectiles such as countermeasures, interceptors, missiles, or rockets, and the system described is merely one exemplary application for the invention. Further, the present invention may employ any number of conventional techniques for launching projectiles, targeting objects, propulsion, and the like.

Figure 1:
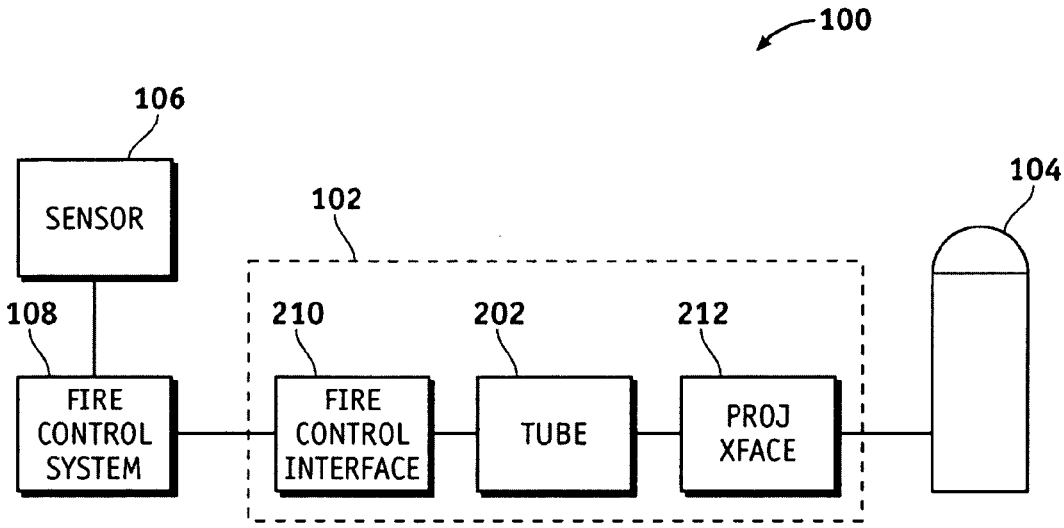
FIG. 1 is a diagram of a countermeasure system according to various aspects of the present invention.
Figure 2:
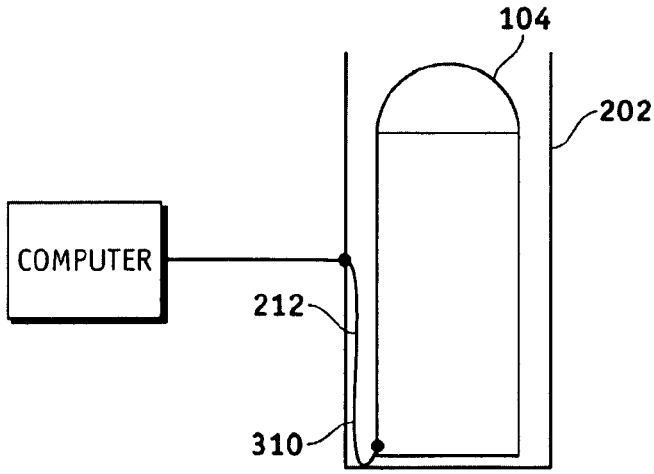
FIG. 2 is a cross-sectional illustration of a projectile in a tube launcher.

Methods and apparatus for fire control according to various aspects of the present invention may operate in conjunction with a countermeasure system that launches of an effector, such as the launch of one or more projectiles, in response to a threat. Referring now to FIGS. 1 and 2, one embodiment for methods and apparatus for countermeasures may operate in conjunction with a projectile 104, a launcher 102, a sensor 106, and a fire control system 108. The fire control system 108 is connected to the projectile via the launcher 102, and controls the launch of the projectile 104 from the launcher 102. The fire control system 108 may control the launch of the projectile 104 according to data from the sensor 106. The present countermeasure system 100 is configured for intercepting short-range threats, such as threats posed by rocket-propelled grenades (RPGs) to military units. Such threats involve very brief intervals for target detection, identification, tracking and intercept. Various aspects of the present invention, however, may be adapted for other countermeasure systems or other systems for launching effectors.

The projectile 104 may comprise a moving system, for example to deliver a payload. The projectile 104 may comprise any system operating in conjunction with the launcher 102, such as a missile, a rocket, or an aircraft. In one exemplary embodiment, the projectile 104 comprises a guided countermeasure intended to intercept an incoming threat. For example, the projectile 104 may comprise a countermeasure against a rocket propelled grenade (RPG). In the present embodiment, the projectile 104 comprises a short-range countermeasure missile comprising a forward-firing warhead. The countermeasure projectile 104 may be adapted for vertical launch while receiving a fire control solution. The projectile 104 may include control elements, such as fins and/or pitch-over thrusters, to guide the projectile 104 to the target intercept site after launch in accordance with the fire control solution, as well as a fuze for detonating the projectile 104 based on the fire control solution or other criteria, such as target proximity or a timer. The projectile 104 may, however, comprise any appropriate projectile, such as a cargo delivery system, an air-to-air, surface-to-air, air-to-surface, or surface-to-surface missile, an underwater- or space-based projectile, or other system. Further, the projectile 104 may comprise or be replaced by a non-projectile effector, such as a sensor or other deployable element.

The launcher 102 launches the projectile 104 in response to signals from the fire control system 108. The launcher 102 may comprise any suitable launch system, such as a conventional launch tube or canister. Referring to FIG. 2, in an exemplary embodiment, the launcher 102 comprises a tube launcher 202 configured to house at least one projectile 104. The launcher 102 may further be configured to house the projectile 104 in a substantially vertical position prior to launch. For example, the launcher 102 may be installed on a vehicle and positioned at a ninety degree angle relative to the ground to launch the projectile 104 vertically upwards with respect to the vehicle.

The launcher 102 may comprise any additional systems for launching the projectile, such as a fire control system interface 210 and a projectile interface 212. The fire control system interface 210 effects communication between the fire control system 210 and the launcher 102. The projectile interface 212 effects communication between the launcher 102 and the projectile 104.

The fire control system interface 210 may comprise any suitable system for receiving communications from the fire control system 108 and/or providing communications to the fire control system 108. In one embodiment, the fire control system interface 210 comprises a launch control box, such as a conventional launch control box including arming systems and communication elements for exchanging signals with the fire control system 108.

In the present embodiment, the fire control system interface 210 receives a fire control solution and a launch signal from the fire control system 108. The fire control solution comprises data for guiding the projectile 104 to a target intercept site, for example to destroy or disable an incoming threat. The launch signal indicates whether and when to launch the projectile 104. The fire control system interface 210 may facilitate the exchange of other suitable signals between the launcher 102 and the fire control system 108, such as status check, diagnostics, command echo, fire control solution readback, or other appropriate signals.

The projectile interface 212 may comprise any appropriate system for facilitating communications between the projectile 104 and the launcher 102. In the present embodiment, the projectile interface 212 transfers fire control solution signals to the projectile 104 to guide the projectile 104 and the launch signal to initiate launch of the projectile 104. The projectile interface 212 may also facilitate transfer of other signals, such as status check, diagnostics, command echo, fire control solution readback, or other appropriate signals.

The projectile interface 212 may comprise a physical or wireless medium for transferring signals. For example, the projectile interface 212 may comprise wireless RF transmitters and/or receivers associated with the launcher 102 and the projectile 104 for exchanging signals. Alternatively, the projectile interface 212 may comprise a physical interface such as a ribbon cable, one or more serial interface cables, coaxial cables, rigid connectors, or slots.

The projectile interface 212 may continue to transfer signals to the projectile 104 after initiation of the launch from the launcher 102, such as until the projectile 104 completes egress from the tube. For example, the projectile interface 104 may remain connected to the projectile 104 while the projectile 104 is moving through the tube and disconnect from the projectile 104 at some point after the projectile 104 begins moving, such as during or after egress from the tube. Maintaining connection of the projectile interface 212 facilitates updating the fire control solution to the projectile 104 during the launch until the projectile interface 212 disconnects.

In one embodiment, the projectile interface 212 comprises a tether 310 comprising a substantially flexible material connected to the launcher 102 and the projectile 104. The tether 310 may comprise any appropriate flexible medium for transferring signals, such as flexible metal conductors or fiber optics. One end of the tether is secured to the tube and the other end is detachably connected to the projectile 104. The tether 310 is adapted to remain connected to the projectile 104 prior to launch and after initiation of launch while the projectile 104 is exiting the tube. At some point during or after egress, the tether 310 detaches from the projectile 104, such as in response to the tether 310 becoming taut and pulling away from the projectile with 104 a selected detachment force.

The projectile interface 212 may comprise alternative systems for transferring signals to the projectile 104 while the projectile is moving, such as rigid connectors than maintain contact while the projectile is moving. For example, the projectile interface 212 may comprise an electrical connector extending from the bottom of the projectile 104 and contacting a conductive strip along the vertical interior of the tube. Alternatively, the projectile interface 212 may comprise an electrical connector extending from the top of the tube and contacting a conductive strip running along the side of the projectile 104. In either case, as the projectile 104 moves relative to the tube, the electrical connector remains in contact with the conductive strip until the projectile 104 exits the tube, facilitating communications between the projectile 104 and the launcher 102.

The sensor 106 generates signals corresponding to the target of the projectile 104 and/or other environmental data, such as wind speed or friendly unit locations. The sensor 106 may comprise any suitable sensor for generating any appropriate target data. In the present embodiment, the sensor 106 comprises a tracking system for identifying and tracking targets, such as a radar system, infrared sensor, navigation systems, depth indicators, sonar, electronic warfare equipment, data systems, or other suitable source of relevant data. In the present embodiment, the sensor 106 comprises an active electronically steered array having sufficient range and resolution to identify relevant threats, such as incoming RPGs. Other embodiments may comprise other sensor and/or data systems, such as phased array radars, planar radar arrays, a conventional antenna, a forward-looking infrared sensor, semi-active laser sensors, or a combination of data received from one or more other sensors.

In the present embodiment, the sensor 106 generates target data at a frequency such that the firing solution may be calculated or updated between initiation of launch and loss of the connection to the projectile 104. For example, the sensor 106 may generate updated target information at 30 to 40 millisecond intervals, while the projectile 104 may require 50 to 100 milliseconds to exit the launcher 102 from assertion of the launch signal. The updated target information may be provided by the sensor 106 to the fire control system 108 to provide an updated fire control solution to the projectile 104 while the projectile 104 has already started moving in response to the launch signal.

The fire control system 108 receives data from the sensor 106 and generates guidance data for the projectile 104. The fire control system 108 may comprise any appropriate system for generating guidance data for the projectile 104 according to data from the sensor 106. For example, the fire control system 108 may comprise a conventional computer comprising a processor and a memory. In the present embodiment, the fire control system 108 operates on a VME chassis. The fire control system 108 may perform any appropriate tasks associated with firing the projectile 104, such as processing the sensor 106 data to detect, discriminate, and track targets, establish a time to launch and generate a launch signal to launch the projectile 104, and calculate the fire control solution.

In the present embodiment, the fire control system 108 receives the data from the sensor 106 and selects one or more targets for intercept by the projectile 104. For example, the fire control system 108 may process the sensor 106 data according to target tracking algorithms to detect incoming projectiles, identify them as threats, and establish tracks for the threats, such as using conventional algorithms based on range and velocity data. The fire control system 108 may also determine whether to launch the projectile 104 in response to the detected threat. For example, the fire control system 108 may select a particular projectile 104 from multiple projectiles 104 available for deployment. In addition, the fire control system 108 may determine whether to launch the projectile 104, such as based on likelihood of impact, probability that the incoming threat is actually a decoy, potential danger to friendlies, or other criteria.

If the fire control system 108 elects to launch the projectile 104, the fire control system 108 may compute a time-to-launch. For example, the fire control system 108 may identify a time at which the incoming threat will be within range of the projectile 104 or likely to become an immediate threat. The fire control system 108 may then initiate the launch in accordance with the computed time-to-launch, such as by asserting a launch signal to the launcher 102.

The fire control system 108 may further compute a fire control solution for guiding and/or detonating the projectile 104. For example, the fire control solution 108 may receive sensor 106 data and generate a target track. The fire control system 108 may generate the fire control solution based on any relevant data, such as the relative motion of the target to the launcher 102, characteristics of the projectile 104, and exterior ballistics. In one embodiment, the fire control system 108 may generate the fire control solution using conventional algorithms and techniques based on target position, course, speed and bearing, relative velocities, bearing change rate, range change rate, speed across line-of-sight, estimated target position, gravity, drag, wind, drift, Coriolis effects, and/or any other relevant factors.

The fire control system 108 may provide the fire control solution to the projectile 104 to guide the projectile 104 to the target. For example, the fire control system 108 may provide the fire control solution to the projectile 104 immediately preceding launch, at the time of launch, and/or following launch. In addition, the fire control system 108 may update the fire control solution provided to the projectile 104 until the connection to the projectile 104, such as via the projectile interface 212, is lost.

In the present embodiment, the fire control system 108 provides the final fire control solution to the projectile 104 after the projectile 104 has initiated launch and before the connection to the projectile 104 via the projectile interface 212 is broken. For example, the fire control system 108 may provide an initial fire control solution to the projectile 104 and continue updating the fire control solution until the projectile interface 212 link terminates. Alternatively, the fire control system 108 may initiate the launch, which starts the projectile 104 moving within the launcher 102. In the meantime, the fire control system 108 may continue receiving target data from the sensor 106 and/or calculating the fire control solution while the projectile 104 is egressing the launcher 102. The fire control system 108 may provide the final fire control solution or an updated fire control solution to the projectile 104 before the tether 310 detaches from the projectile 104 or communication with the projectile 104 is otherwise lost.

By delivering the fire control solution after the projectile 104 has begun launch, the latest sensor 106 data may be used to compute the fire control solution. In addition, the launch process may begin without waiting for the fire control system 108 to complete calculation and delivery of the fire control solution to the projectile to provide an optimal fire control solution and fast reaction time. In addition, updating the fire control solution during egress of the projectile 104 may compensate for variations in egress timing characteristics among projectiles 104 and launching methods.

Figure 3D:
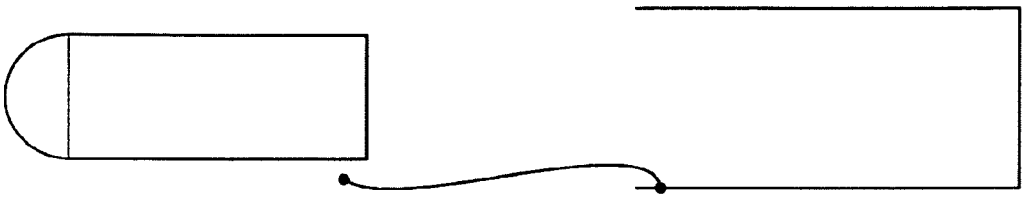
FIG. 3 representatively illustrates the projectile exiting the tube launcher.
Figure 3C:
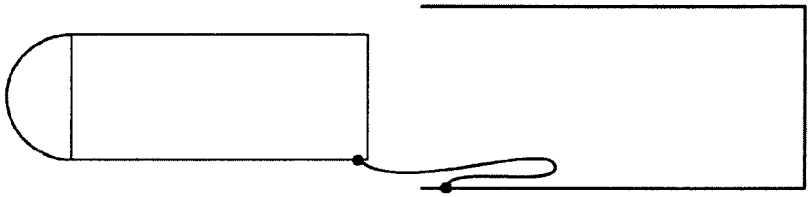
Figure 3B:
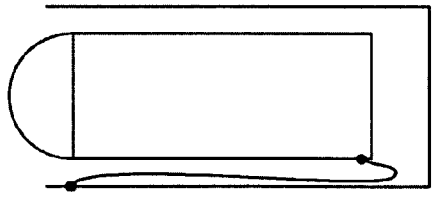
Figure 3A:
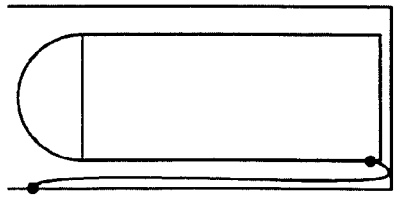
Figure 4:
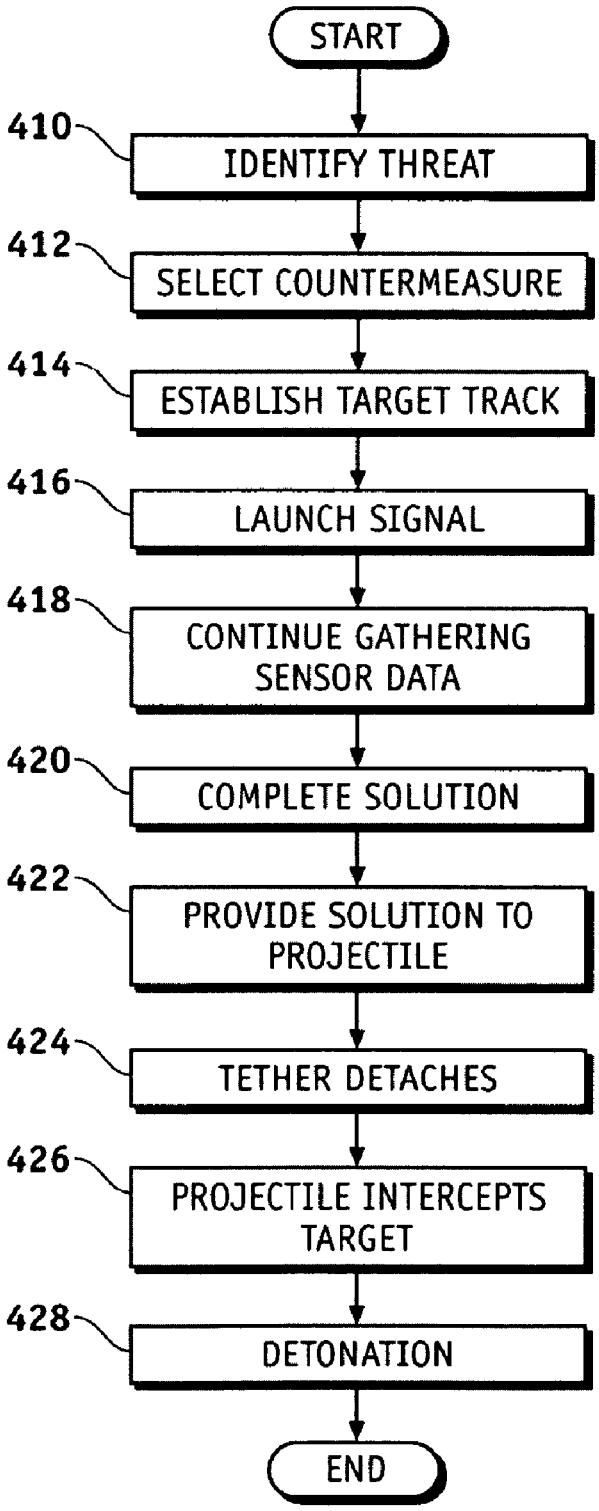
FIG. 4 is a flow chart representatively illustrating a fire control process.

Referring to FIGS. 3 and 4, the countermeasure system 100 may begin operation with the projectile 104 loaded within the launcher 102 (FIG. 3A) while the sensor 106 monitors an area. The sensor 106 transfers data to the fire control system 108, which analyzes the data to detect and identify threats.

Upon identification of a threat (410), the fire control system 108 may select an appropriate countermeasure projectile 104 (412) and establish a track for the identified threat (414). The fire control system 108 may assert the launch signal (416), causing the projectile 104 to initiate launch from the launcher 102 (FIG. 3B).

The fire control system 108 may generate a fire control solution for the projectile 104. While the projectile 104 is exiting the launcher 102, the sensor 106 continues to provide target data to the fire control system 108 (418). The fire control system 108 completes the final fire control solution (420) based on the sensor 106 data and provides the final fire control solution to the projectile 104 while the tether 310 remains connected to the projectile 104 (422) (FIG. 3C). The final fire control solution may be delivered as the only fire control solution, or may be provided as an update to a previously delivered fire control solution. As the projectile 104 leaves the launcher 102, the tether 310 detaches from the projectile 104 (424) (FIG. 3D), and the projectile 104 proceeds according to the fire control solution (426). The projectile 104 may approach the target and detonate according to the fire control solution (428), and the target is disabled or destroyed.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A launch system for launching a projectile, comprising:
a launcher; and
a communications link coupled to the launcher and the projectile, wherein the communications link is:
detachably coupled to at least one of the launcher and the projectile;
adapted to communicate a fire control solution from the launcher to the projectile after the projectile has been launched and as the projectile is exiting the launcher; and
adapted to detach from at least one of the launcher and the projectile:
after the fire control solution has been communicated to the projectile and the projectile has moved a selected distance relative to the launcher as the projectile is exiting the launcher; and
before the projectile proceeds to follow a path corresponding to the fire control solution,
wherein the projectile follows the path corresponding to the fire control solution without additional communication after the communications link has detached.

2. A launch system according to claim 1, wherein the communications link comprises a flexible tether.

3. A launch system according to claim 1, further comprising a fire control system coupled to the launcher and adapted to provide the fire control solution to the projectile via the communications link after the projectile has been launched.

4. A launch system according to claim 3, wherein the fire control system is further adapted to provide the fire control solution to the projectile by providing an updated fire control solution after the projectile has been launched and prior to the detachment of the communications link.

5. A launch system according to claim 4, wherein the fire control system is adapted to:
receive additional data relating to a target after the projectile has been launched; and
generate the updated fire control solution according to the additional target data.

6. A launch system according to claim 5, wherein the additional data comprises velocity and range data for a target to be intercepted by the projectile.

7. A method for controlling a projectile, comprising:
generating a fire control solution for the projectile;
launching the projectile from a launcher;
communicating the fire control solution to the projectile after launching the projectile via a communications link coupled to the launcher and the projectile, wherein the communications link is detachably coupled to at least one of the launcher and the projectile; and
detaching the communications link from the at least one of the launcher and the projectile when the projectile moves a selected distance relative to the launcher during an egress of the projectile from the launcher after the projectile has been launched and the fire control solution, provided to the projectile, wherein the projectile follows a path corresponding to the fire control solution without additional communication after the communications link has been detached.

8. A method for controlling a projectile according to claim 7, wherein the communications link comprises a flexible tether.

9. A method for controlling a projectile according to claim 7, wherein the fire control solution is generated after launching the projectile.

10. A method for controlling a projectile according to claim 7, wherein providing the fire control solution comprises providing an updated fire control solution.

11. A method for controlling a projectile according to claim 7, further comprising:
receiving additional data relating to a target after launching the projectile; and
generating the fire control solution according to the additional target data.

12. A method for controlling a projectile according to claim 11, wherein the additional data comprises velocity and range data for the target.

13. A launch system for firing a countermeasure projectile to intercept a target, comprising:
a radar system;
a launcher configured to house the projectile prior to firing;
a flexible tether detachably connected to the projectile and the launcher, wherein the flexible tether is adapted to:
communicate signals to the projectile, wherein the signals comprise:
a launch signal; and
a fire control solution for guiding the projectile the target; and
detach from the projectile after the signals have been communicated to the projectile and the projectile has moved a selected distance relative to the launcher during an egress of the projectile from the launcher after the projectile has been launched following the launch signal; and
a fire control system responsive to the radar system and coupled to the flexible tether, wherein the fire control system initiates the signals communicated to the projectile, and wherein
the projectile follows a path corresponding to the fire control solution without additional communication after the flexible tether has been detached from the projectile.

14. A launch system according to claim 13, wherein the radar system comprises an active electronically steered array.

15. A launch system according to claim 13, wherein the fire control system is configured to generate an updated fire control solution after initiating the launch signal and prior to the detachment of the flexible tether.

16. A launch system according to claim 13, wherein the fire control system is adapted to:
receive additional data from the radar system after launch of the projectile; and
generate an updated fire control solution according to the additional target data prior to the detachment of the flexible tether.

17. A launch system according to claim 16, wherein the additional data comprises velocity and range data for a target to be intercepted by the projectile.

* * * * *